US006050698A

United States Patent [19]

Lee

[11] Patent Number: 6,050,698

[45] Date of Patent: Apr. 18, 2000

[54] SCREWDRIVER HAVING A FLASHLIGHT

[76] Inventor: Wen-Sung Lee, 8F-2, No. 60-2, Industrial Park, Taichung, Taiwan

[21] Appl. No.: 09/241,147

[22] Filed: Feb. 1, 1999

[30] Foreign Application Priority Data

Jul. 13, 1998 [TW] Taiwan ..... 87211229

[51] Int. Cl.[7] ..... B28B 23/18

[52] U.S. Cl. ..... 362/120; 362/119

[58] Field of Search ..... 362/109, 119, 362/120, 578

[56] References Cited

U.S. PATENT DOCUMENTS 2,706,769 4/1955 Cook ..... 362/120

3,603,782 9/1971 Wortmann ..... 362/120

5,713,656 2/1998 Lin ..... 362/120

*Primary Examiner*—Stephen Husar

*Attorney, Agent, or Firm*—Alan Kamrath; Oppenheimer, Wolff & Donnelly LLP

[57] ABSTRACT

A screwdriver/flashlight union device has a hollow main body, a flashlight device disposed in the hollow main body, a transparent front casing disposed on a front portion of the hollow main body, a chuck sleeve disposed on the transparent front casing, a rear casing disposed on a rear portion of the hollow main body, a cover covering a rear portion of the rear casing, a hollow click seat inserted in the rear casing, and a hollow cylinder seat inserted in the hollow click seat. A plurality of bits are disposed in the hollow main body.

3 Claims, 3 Drawing Sheets

SCREWDRIVER HAVING A FLASHLIGHT

BACKGROUND OF THE INVENTION

The present invention relates to a screwdriver which has a flashlight. More particularly, the present invention relates to a screwdriver/flashlight union device.

A conventional screwdriver does not have a flashlight. The user has to hold a flashlight with one hand and hold the conventional screwdriver with the other hand.

SUMMARY OF THE INVENTION

An object of the present invention is to provide a screwdriver/flashlight union device which can receive a plurality of bits.

Another object of the present invention is to provide a screwdriver/flashlight union device which can illuminate a screwdriver while the screwdriver is operated.

Accordingly, a screwdriver/flashlight union device comprises a hollow main body, a flashlight device disposed in the hollow main body, a transparent front casing disposed on a front portion of the hollow main body, a chuck sleeve disposed on the transparent front casing, a rear casing disposed on a rear portion of the hollow main body, a cover covering a rear portion of the rear casing, a hollow click seat inserted in the rear casing, and a hollow cylinder seat inserted in the hollow click seat. The hollow main body has an inner flange to block a rear portion of the transparent front casing, an oblong hole formed on an upper portion of the hollow main body to receive a button, two notches formed on a rear portion of the hollow main body, two pairs of recesses formed on the rear portion of the hollow main body to communicate with the respective notch, and two positioning holes formed on the rear portion of the hollow main body. The button has a push plate. A light-reflection disk is inserted in the rear portion of the transparent front casing. A plurality of guide rails are disposed in a front end of the hollow main body to confine the light-reflection disk. The transparent front casing has a hexagonal hole and two rear hook plates. A rear portion of the chuck sleeve is inserted in the hexagonal hole. The rear casing has two front lugs to engage with the notches, two click bars disposed on the front lugs to engage with the recesses, an inner pipe disposed in the rear casing, a rear slot receiving the cover, a rear groove communicating with the rear slot, two apertures, and two inner mortises disposed in a front portion of the inner pipe. The hollow cylinder seat has two periphery flanges and two end tenons. Each of the end tenons engages with the respective inner mortise. The hollow click seat has two leg plates and an annular block flange. Each of the leg plates has an end protrusion. The cover has a click hook and two protruded balls. Each of the protruded balls is inserted in the respective aperture. The click hook is inserted in the rear groove.

DETAILED DESCRIPTION OF THE INVENTION

Figure 1:
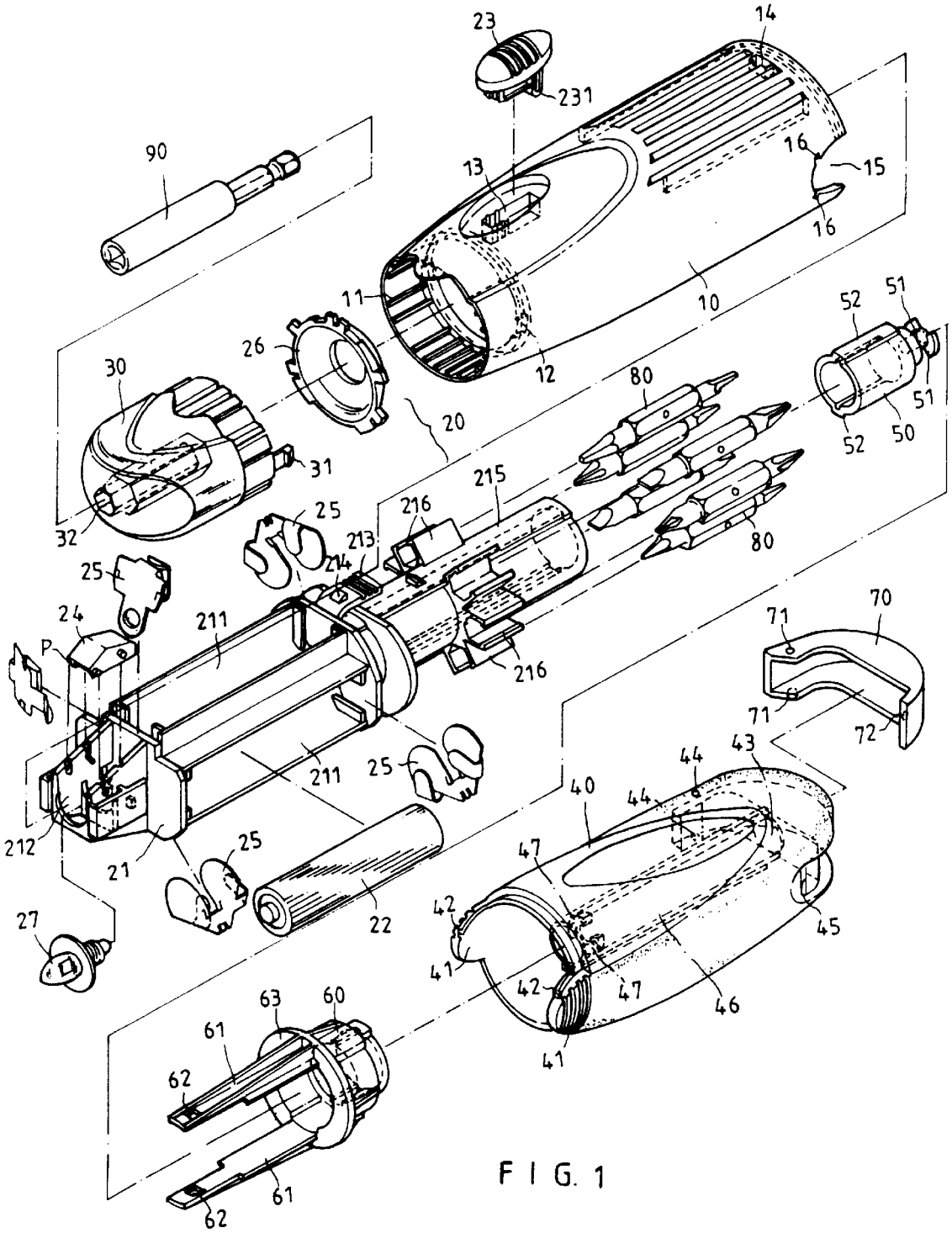
FIG. 1 is a perspective exploded view of a screwdriver having a flashlight of a preferred embodiment in accordance with the present invention.
Figure 2:
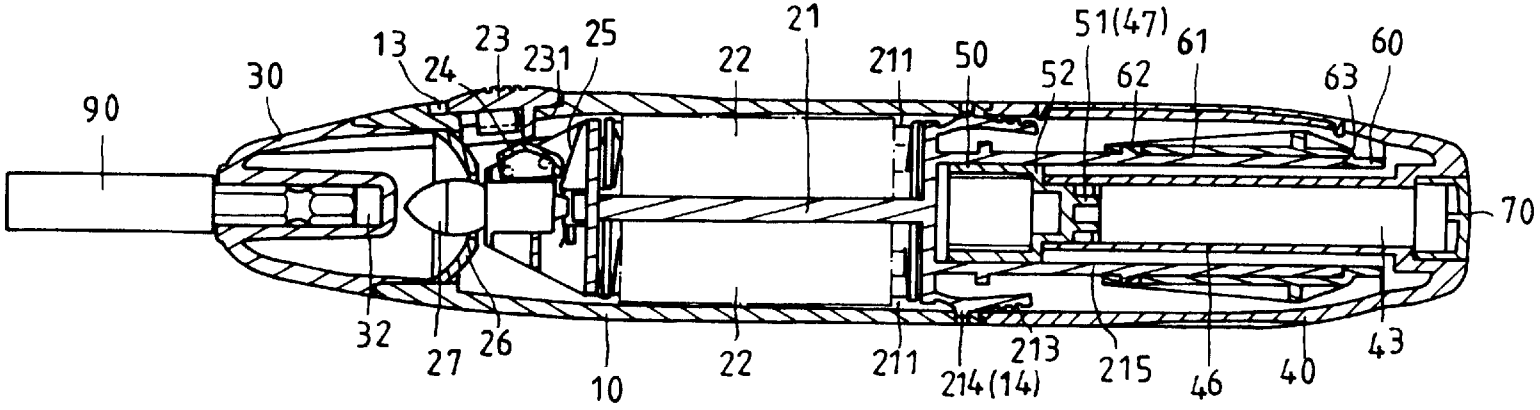
FIG. 2 is a sectional assembly view of a screwdriver having a flashlight of a preferred embodiment while the flashlight is not operated.

Referring to FIGS. 1 and 2, a screwdriver/flashlight union device comprises a hollow main body 10, a flashlight device 20 disposed in the hollow main body 10, a transparent front casing 30 disposed on a front portion of the hollow main body 10, a chuck sleeve 90 disposed on the transparent front casing 30, a rear casing 40 disposed on a rear portion of the hollow main body 10, a cover 70 covering a rear portion of the rear casing 40, a hollow click seat 60 inserted in the rear casing 40, and a hollow cylinder seat 50 inserted in the hollow click seat 60.

The hollow main body 10 has an inner flange 12 to block a rear portion of the transparent front casing 30, an oblong hole 13 formed on an upper portion of the hollow main body 10 to receive a button 23, two notches 15 formed on a rear portion of the hollow main body 10, two pairs of recesses 16 formed on the rear portion of the hollow main body 10 to communicate with the respective notch 15, and two positioning holes 14 formed on the rear portion of the hollow main body 10. The button 23 has a push plate 231.

A light-reflection disk 26 is inserted in the rear portion of the transparent front casing 30.

A plurality of guide rails 11 are disposed in a front end of the hollow main body 10 to confine the light-reflection disk 26.

The transparent front casing 30 has a hexagonal hole 32 and two rear hook plates 31. A rear portion of the chuck sleeve 90 is inserted in the hexagonal hole 32.

The rear casing 40 has two front lugs 41 to engage with the notches 15, two click bars 42 disposed on the front lugs 41 to engage with the recesses 16, an inner pipe 46 disposed in the rear casing 40, a rear slot 43 receiving the cover 70, a rear groove 45 communicating with the rear slot 45, two apertures 44, and two inner mortises 47 disposed in a front portion of the inner pipe 46.

The hollow cylinder seat 50 has two periphery flanges 52 and two end tenons 51. Each of the end tenons 51 engages with the respective inner mortise 47.

The hollow click seat 60 has two leg plates 61 and an annular block flange 63. Each of the leg plates 61 has an end protrusion 62.

The cover 70 has a click hook 72 and two protruded balls 71. Each of the protruded balls 71 is inserted in the respective aperture 44. The click hook 72 is inserted in the rear groove 45.

The flashlight device 20 has the light-reflection disk 26, a battery seat 21 inserted in the hollow main body 10, a tube 215 connected to the battery seat 21, a plurality of positioning plates 216 disposed on the tube 215 to receive bits 80, two plastic plates 213, two positioning blocks 214 disposed on the plastic plates 213 and inserted in the positioning holes 14, two battery chambers 211 defined by the battery seat 21, a socket seat 212 disposed on a front portion of the battery seat 21, a lamp 27 inserted in the socket seat 212, and a slide block 24 inserted in the socket seat 212. The slide block 24 contacts the push plate 231. Two pins P fasten the slide block 24 and the socket seat 212 together.

Each of the battery chambers 211 receives a battery 22 and two elastic plates 25. The slide block 24 is pressed by one of the elastic plates 25.

Figure 3:
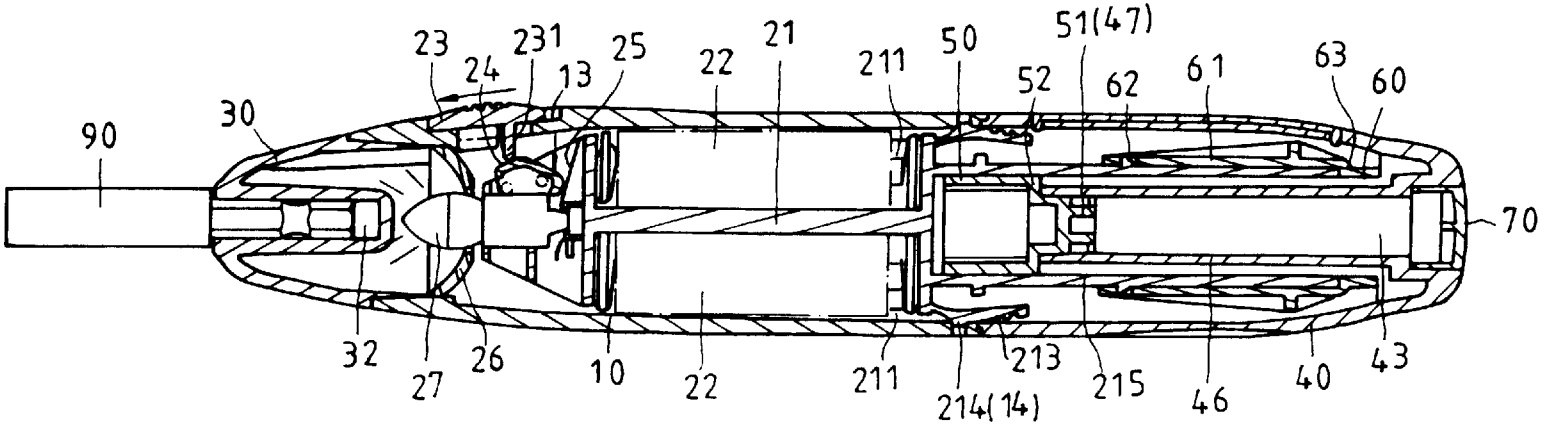
FIG. 3 is a sectional assembly view of a screwdriver having a flashlight of a preferred embodiment while the flashlight is operated.

FIG. 3 is a sectional assembly view of the screwdriver/flashlight union device while the flashlight device 20 is operated.

Figure 4:
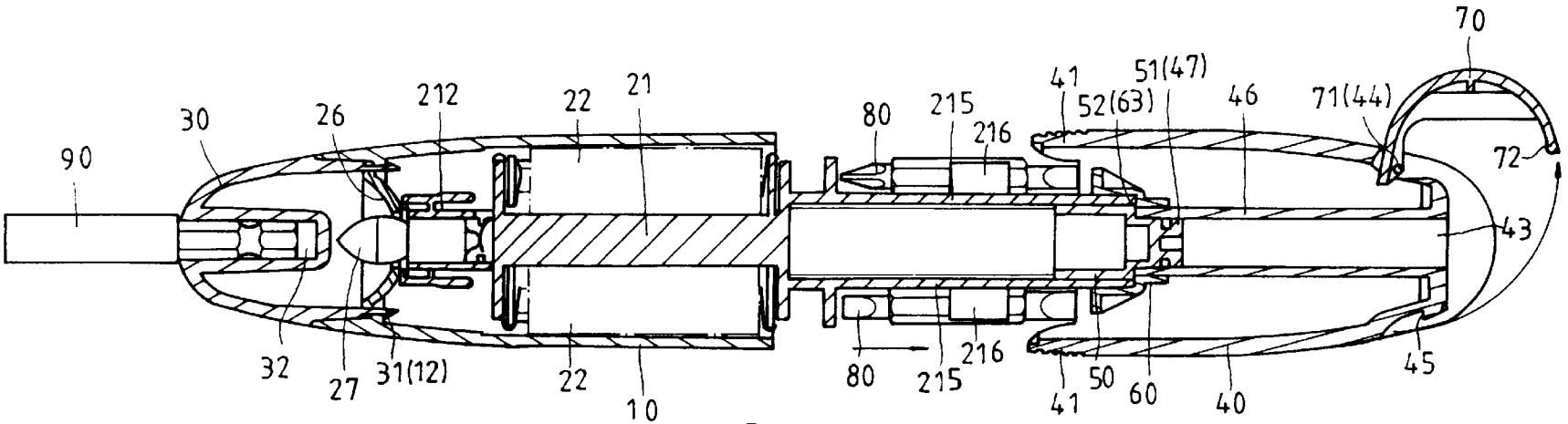
FIG. 4 is a sectional assembly view of a screwdriver having a flashlight of a preferred embodiment while a rear casing is pulled rearward.

FIG. 4 is a sectional assembly view of the screwdriver/flashlight union device while the rear casing 40 is pulled rearward.

Figure 5:
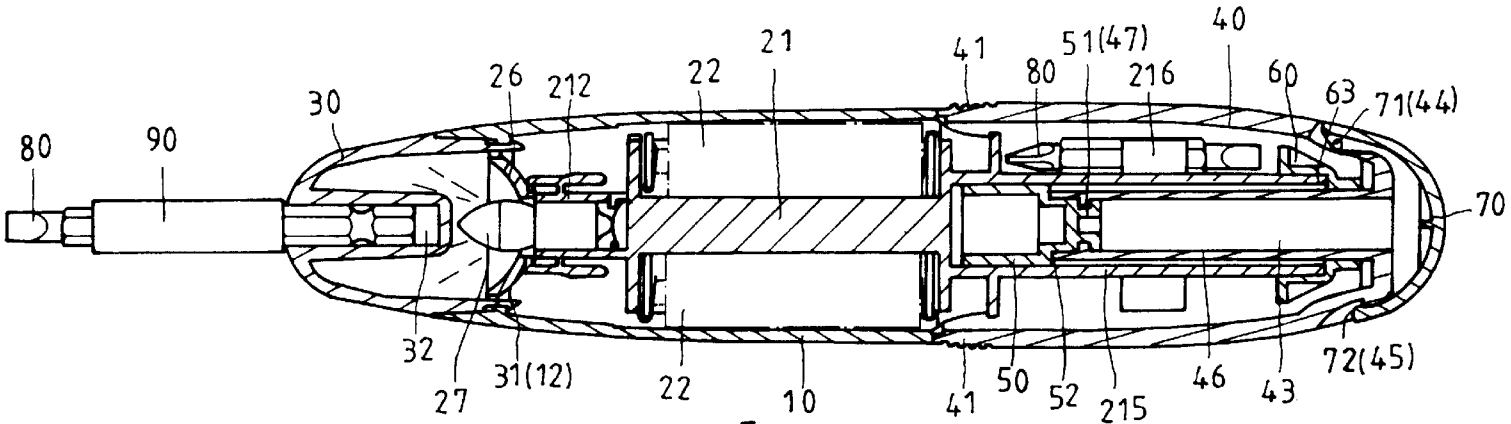
FIG. 5 is a sectional assembly view of a screwdriver having a flashlight of a preferred embodiment while the flashlight is operated and a bit is disposed on a chuck sleeve.

FIG. 5 is a sectional assembly view of the screwdriver/flashlight union device while the flashlight device 20 is operated and a bit 80 is disposed on the chuck sleeve 90.

The present invention provides a screwdriver/flashlight union device which can illuminate the chuck sleeve 90 while the screwdriver/flashlight union device is operated.

The present invention is not limited to the above embodiment but various modification thereof may be made. Furthermore, various changes in form and detail may be made without departing from the scope of the present invention.

I claim:

1. It screwdriver/flashlight union device comprising:

a hollow main body, a flashlight device disposed in the hollow main body, a transparent front casing disposed on a front portion of the hollow main body, a chuck sleeve disposed on the transparent front casing, a rear casing disposed on a rear portion of the hollow main body, a cover covering a rear portion of the rear casing, a hollow click seat inserted in the rear casing, and a hollow cylinder seat inserted in the hollow click seat, the hollow main body having an inner flange to block a rear portion of the transparent front casing, an oblong hole formed on an upper portion of the hollow main body to receive a button, two notches formed on a rear portion of the hollow main body, two pairs of recesses formed on the rear portion of the hollow main body to communicate with the respective notch, and two positioning holes formed on the rear portion of the hollow main body, the button having a push plate, a light-reflection disk inserted in the rear portion of the transparent front casing, a plurality of guide rails disposed in a front end of the hollow main body to confine the light-reflection disk, the transparent front casing having a hexagonal hole and two rear hook plates, a rear portion of the chuck sleeve inserted in the hexagonal hole, the rear casing having two front lugs to engage with the notches, two click bars disposed on the front lugs to engage with the recesses, an inner pipe disposed in the rear casing, a rear slot receiving the cover, a rear groove communicating with the rear slot, two apertures, and two inner mortises disposed in a front portion of the inner pipe, the hollow cylinder seat having two periphery flanges and two end tenons, each said end tenon engaging with the respective inner mortise, the hollow click seat having two leg plates and an annular block flange, each said leg plate having an end protrusion, the cover having a click hook and two protruded balls, each said protruded ball inserted in the respective aperture, and the click hook inserted in the rear groove.

2. A screwdriver/flashlight union device as claimed in claim 1, wherein the flashlight device has the light-reflection disk, a battery seat inserted in the hollow main body, a tube connected to the battery seat, a plurality of positioning plates disposed on the tube, two plastic plates, two positioning blocks disposed on the plastic plates and inserted in the positioning holes, two battery chambers defined by the battery seat, a socket seat disposed on a front portion of the battery seat, a lamp inserted in the socket seat, and a slide block inserted in the socket seat.

3. A screwdriver/flashlight union device as claimed in claim 2, wherein each said battery chamber receives a battery and two elastic plates.

* * * * *